US007000631B2

(12) United States Patent
LaPrise

(10) Patent No.: US 7,000,631 B2
(45) Date of Patent: Feb. 21, 2006

(54) APPARATUS FOR MAINTAINING FLUID TEMPERATURE

(76) Inventor: Vincent A. LaPrise, 55549 Danube Ave., Macomb Township, MI (US) 48042

( * ) Notice: Subject to any disclaimer, the term of this patent is extended or adjusted under 35 U.S.C. 154(b) by 0 days.

(21) Appl. No.: 10/908,257

(22) Filed: May 4, 2005

(65) Prior Publication Data

US 2005/0183772 A1 Aug. 25, 2005

Related U.S. Application Data

(63) Continuation-in-part of application No. 10/439,005, filed on May 15, 2003, now abandoned.

(51) Int. Cl.
*F16K 49/00* (2006.01)
*G05D 7/00* (2006.01)

(52) U.S. Cl. ..... 137/337; 122/13.3; 236/93 R

(58) Field of Classification Search ..... 236/93 R; 122/13.3; 137/337, 468
See application file for complete search history.

(56) References Cited

U.S. PATENT DOCUMENTS 2,842,155 A 7/1958 Peters
4,331,292 A 5/1982 Zimmer
4,606,325 A * 8/1986 Lujan, Jr. ..... 122/13.3
5,205,318 A * 4/1993 Massaro et al. ..... 137/337
5,323,803 A 6/1994 Blumenauer
5,622,203 A 4/1997 Givler et al.
5,819,785 A 10/1998 Bardini
6,536,464 B1 3/2003 Lum et al.

* cited by examiner

*Primary Examiner*—Kevin Lee
(74) *Attorney, Agent, or Firm*—Gregory T. Zalecki

(57) ABSTRACT

An apparatus for maintaining water temperature comprised of an inlet, a mechanical temperature controlled shutoff valve, a check valve and an outlet. The shutoff valve and check valve are positioned between the inlet and outlet to provide for the shunting of water from the inlet to the outlet based upon the temperature of the water, thereby maintaining water temperature at the inlet. This permits continuous access to hot water at a faucet which has the apparatus installed between its inlets. The apparatus may be configured as a temperature control assembly and attached in line with a hot water supply system thereby maintaining the hot water temperature within the hot water supply side of the system. Tees may be attached to the to the inlet and outlet of the apparatus as well as the hot water inlet and cold water inlet of a faucet, thereby creating a temperature controlled faucet.

20 Claims, 3 Drawing Sheets

APPARATUS FOR MAINTAINING FLUID TEMPERATURE

This is a continuation in part of U.S. patent application Ser. No. 10/439,005 filed on May 15, 2003 now abandoned.

BACKGROUND

The object of the present invention is to maintain a hot fluid temperature at a desired location in a fluid supply system.

It is desirable to maintain the temperature of hot water at a faucet without any substantial modifications to a traditional plumbing system. Traditional plumbing systems are deficient in maintaining hot water temperatures at a faucet or other plumbing fixture, such as a showerhead. Typically, a person who desires to use hot water opens a valve, such as a faucet or shower control valve, and allows water to flow. Initially, the water is not hot, but rather cold or warm. After a period of time the water becomes hot and is used. This approach not only costs the user time, it also wastes a substantial amount of water because the water flows down a drain while the water temperature slowly rises to the desired temperature.

The problem described arises not only in hot water supply systems, but in any hot fluid supply system using piping to deliver hot and cold fluid from a source to a discharge valve. The temperature of the fluid within a hot fluid supply pipe of a hot fluid supply system decreases to an ambient temperature over time when the fluid is not flowing. As a result, when hot fluid is desired, the user needs to allow the fluid to flow until the temperature at the discharge valve reaches the desired temperature.

Two methods are commonly used to maintain the temperature of water at a discharge valve. Both methods involve recirculating hot water from the hot water side of a hot water supply system back to a source, such as a hot water heater. One method involves routing a pipe from the hot water supply pipe at the furthest fixture within a plumbing system back to the water heater which supplies the hot water to the plumbing system. The installation of such a return line has a substantial cost. Typically, it involves the routing of many feet of piping throughout a house.

A second method involves installing a pump in proximity to a discharge valve between the hot water supply pipe and the cold water supply pipe connected to that discharge valve. This will control water temperature near the fixture by shunting water from the hot water supply pipe to the cold water supply pipe. Often the pump is electrically powered and may be controlled by timing controls, temperature controls or a manual switch which cause the pump to operate at desired times or at desired water temperatures. Such a pump may also be used to enhance the performance of a hot water supply system employing the return line method described above. The pump is installed within the return line to cause the water to be returned to the hot water source.

Several problems are associated with using water pumps. The water pump has a significant cost. The water pump requires electrical power, at a cost, to operate and install. The water pump has a tendency to malfunction and require repairs over time. The water pump emits undesirable noise. Since the water pump is electrically operated within the proximity of water it presents a potential electrical shock safety hazard.

Attempts to address these problems can be found within the following patents: U.S. Pat. Nos. 5,323,803, 5,622,203 and 5,819,785.

There is a need for a simple mechanical fluidic device which will control and maintain fluid temperature at or near a discharge valve. In particular, there is a need for such a device which will control and maintain water temperature at or near a discharge valve. The device should be able to be manufactured at a low cost. It should not emit noise. It should not require electrical power for operation. The maintained and controlled temperature should be manually adjustable from a position outside of the fluid. There is also a need for an adjustable temperature controlled faucet and a temperature controlled hot water supply system having these features.

The present invention satisfies these needs.

SUMMARY

The preferred use for the present invention is the maintenance of water temperature. One version of the invention is an apparatus for maintaining water temperature. An apparatus for maintaining water temperature is comprised of a water inlet, a mechanical ambient air temperature controlled water shutoff valve, a water check valve and a water outlet. Preferably the water inlet is shaped and sized to connect the apparatus to a hot water supply pipe. This will permit the apparatus to be easily connected to the hot water side of a water supply system having a hot water side and a cold water side. Preferably, the water outlet is shaped and sized to connect the apparatus to a cold water supply pipe. This will permit the apparatus to be easily connected to the cold water side of the water supply system.

Typical of such water supply systems is a residential water supply system comprised of a hot water heater and associated pipes. The source of the hot water side of the water supply system is a hot water outlet emanating from the water heater. A hot water supply pipe is connected to the hot water outlet. A cold water inlet also emanates from the hot water heater. The water supply system also has a cold water source. The cold water source is connected, directly or indirectly, to the cold water inlet of the water heater and a cold water supply pipe. Preferably, the water outlet of the apparatus is shaped and sized to connect to the cold water supply pipe.

The ambient air temperature controlled water shutoff valve is mechanically operated. This avoids the noise, operating cost, electrical installation cost, electrical shock hazard and breakdown tendency of an electrically controlled water shutoff valve. Since this invention relies upon thermal convection and pressure balancing of the water supply system, and does not use a pump, the noise, operating cost, electrical installation cost, electrical shock hazard and breakdown tendencies of electrical pumps are also avoided. The mechanical ambient air temperature controlled shutoff valve has an air sensor which controls the opening and closing of the valve. The mechanical ambient air temperature controlled shutoff valve opens upon a falling temperature. As the water cools, the reduced water temperature is communicated to the air sensor by air ambient to the valve. The reduced temperature at the air sensor causes the valve to open. It permits water to flow only when the water temperature falls below a selected temperature. Preferably, the mechanical ambient air temperature controlled water shutoff valve is a commonly available residential or commercial radiator valve. The mechanical ambient air temperature controlled water shutoff valve is connected in series with the water inlet of the apparatus. This permits the starting and stopping of the flow of water based upon the temperature of the water.

The water check valve is connected in series with the ambient air temperature controlled water shutoff valve. The check valve is aligned to permit the flow of water in a direction from hot to cold only. The water outlet of the apparatus is connected in series with the ambient air temperature controlled water shutoff valve and the check valve. The ambient air temperature controlled water shutoff valve and the check valve are positioned between the water inlet and the water outlet of the apparatus. Optimal results are obtained by installing the apparatus at the fixture furthest from the hot water source. This will control and maintain the water temperature at the other fixtures along the hot water branch circuit of the plumbing system.

Optionally, the apparatus may be used to regulate water temperature at a faucet or a discharge valve. The faucet or discharge valve has a hot water inlet and a cold water inlet. The second branch of a first tee having three branches is connected to the water inlet of the apparatus. The first branch of the first tee is sized and shaped to connect to the hot water inlet of the faucet or discharge valve. The third branch of the first tee is sized and shaped to connect to a hot water supply pipe for connecting the apparatus to the hot water side of a water supply system. The second branch of a second tee having three branches is connected to the water outlet of the apparatus. The first branch of the second tee is sized and shaped to connect to the cold water inlet of the faucet or discharge valve. The third branch of the second tee is sized and shaped to connect to a cold water supply pipe for connecting the apparatus to the cold water side of a water supply system. The temperature of water at the junction of the three branches of the first tee is controlled and maintained when a hot water supply pipe is connected to the third branch of the first tee, a cold water supply pipe is connected to the third branch of the second tee, the first branch of the first tee is connected to the hot water inlet of the faucet or discharge valve and the first branch of the second tee is connected to the cold water inlet of the faucet or discharge valve.

Preferably, insulation surrounds the ambient air temperature controlled water shutoff valve. The insulation isolates the ambient air temperature controlled water shutoff valve from outside ambient air and reduces the temperature response time of the ambient air temperature controlled water shutoff valve. Generally the term outside ambient air refers to ambient air outside of and external to the insulation, while the term ambient air refers to air within the insulation which is in contact with the shutoff valve. During the operation of the apparatus heat from the water is transferred to the ambient air surrounding the apparatus. This ambient air is enclosed within the insulation. The second type of ambient air is the air outside of the insulation. The heat from the ambient air within the insulation is transferred to an ambient air sensor on the ambient air temperature controlled water shutoff valve. The insulation facilitates a more rapid temperature response by the ambient air temperature controlled water shutoff valve by maximizing the amount of water heat transferred to the air sensor, by minimizing the amount of water heat bled off to the ambient air outside of the insulation. Preferably, the surrounding insulation is provided by enclosing the ambient air temperature controlled water shutoff valve within an insulation box.

Although this invention is principally directed toward water temperature control and has been described in terms of water based elements, it may also be used to maintain and control the temperature of many fluids. Substituting the term fluid for water within the above description describes the invention as a fluid temperature control device.

Another version of this invention is an adjustable temperature controlled faucet. The temperature controlled faucet is comprised of a faucet having a hot water inlet and a cold water inlet and an apparatus for regulating water temperature configured as a temperature control assembly. The temperature control assembly is comprised of a water inlet, a mechanical ambient air temperature controlled water shutoff valve, a water check valve, a water outlet, a first tee having three branches and a second tee having three branches. The shutoff valve opens upon a falling temperature. It is connected in series with the water inlet. It starts and stops the flow of water based upon the temperature of the water, as previously described. The temperature of the water is communicated to an air sensor on the valve. The water check valve is connected in series with the ambient air temperature controlled water shutoff valve. It is aligned for permitting the flow of water in a direction from hot to cold only. The water outlet is connected in series with the ambient air temperature controlled water shutoff valve and the check valve. The ambient air temperature controlled water shutoff valve and the check valve are positioned between the water inlet and the water outlet. The first branch of the first tee is connected to the hot water inlet of the faucet. The second branch of the first tee is connected to the inlet of the temperature control assembly. The third branch of the first tee is sized and shaped to connect to a hot water supply pipe for connecting the temperature control assembly to the hot water side of a water supply system having a hot water side and a cold water side. The first branch of the second tee is connected to the cold water inlet of the faucet. The second branch of the second tee is connected to the outlet of the temperature control assembly. The third branch of the second tee is sized and shaped to connect to a cold water supply pipe for connecting the temperature control assembly to the cold water side of the water supply system. The temperature of water at the junction of the three branches of the first tee is controlled and maintained when a hot water supply pipe is connected to the third branch of the first tee and a cold water supply pipe is connected to the third branch of the second tee. Preferably, the temperature controlled faucet further comprises insulation surrounding the ambient air temperature controlled water shutoff valve. The insulation isolates the ambient air temperature controlled water shutoff valve from ambient air outside of the insulation and reduces the water temperature response time of the ambient air temperature controlled water shutoff valve, as previously described.

An additional version of the invention is a temperature controlled hot water supply system. The temperature controlled hot water supply system is comprised of a hot water heater, a hot water supply pipe, a cold water supply pipe and an apparatus for maintaining water temperature configured as a temperature control assembly. The temperature control assembly is comprised of a water, a water outlet, a mechanical ambient air temperature controlled water shutoff valve, and a water check valve. The hot water heater has a cold water inlet and a hot water outlet. The hot water supply pipe has two terminations. One termination is connected to the hot water outlet of the water heater. The cold water supply pipe also has two terminations. One termination is connected to the cold water inlet of the water heater. The ambient air temperature controlled water shutoff valve opens upon a falling temperature. It has an air sensor which controls the opening and closing of the valve. The temperature of the water is communicated to the air sensor by air ambient to the valve. Preferably, the valve is a commonly available residential or commercial radiator valve. The valve is connected in series with the water inlet of the temperature control assembly. It is positioned to lie between the water inlet of the temperature control assembly and the water outlet of the temperature control assembly. The shutoff valve starts and stops the flow of water based upon the temperature of the water. The check valve is connected in series with the water shutoff valve and the water outlet of the temperature control assembly. It is aligned for permitting the flow of water in a direction from hot to cold only. The temperature control assembly water inlet is connected to the other hot water supply pipe termination. The temperature control assembly water outlet is connected to the other cold water supply termination. The flow of water between said other termination of the hot water supply pipe and said other termination of cold water supply pipe is regulated based upon water temperature, as previously described the to. The temperature of water within the hot water supply pipe is also controlled and maintained. Preferably, the temperature controlled hot water supply system further comprises insulation surrounding the ambient air temperature controlled water shutoff valve. The insulation isolates the ambient air temperature controlled water shutoff valve from ambient air outside of the insulation and reduces the water temperature response time of the ambient air temperature controlled water shutoff valve, as previously described.

DRAWINGS

These and other features, aspects, and advantages of the present invention will become better understood with regard to the following description, appended claims, and accompanying drawings where:

DETAILED DESCRIPTION

Figure 5:
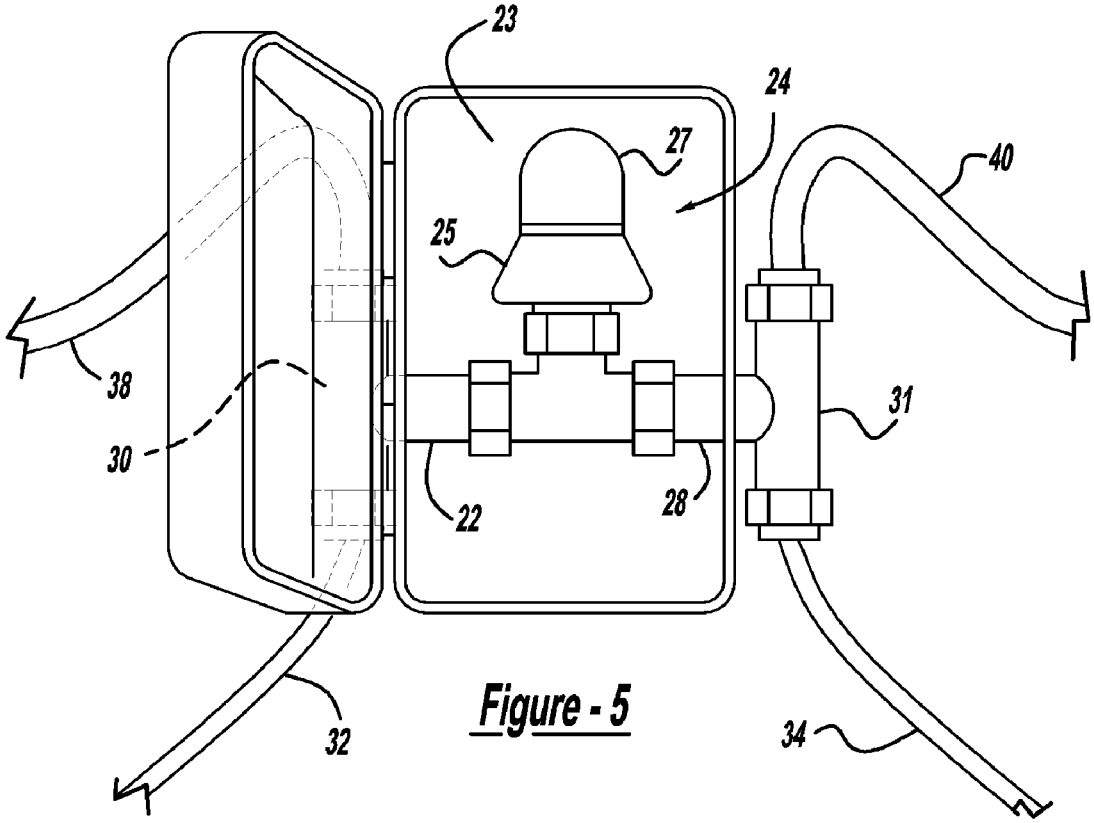
FIG. 5 is a perspective view of the apparatus for maintaining water temperature enclosed within an insulation box with a door of FIG. 4, wherein the door is open.
Figure 6:
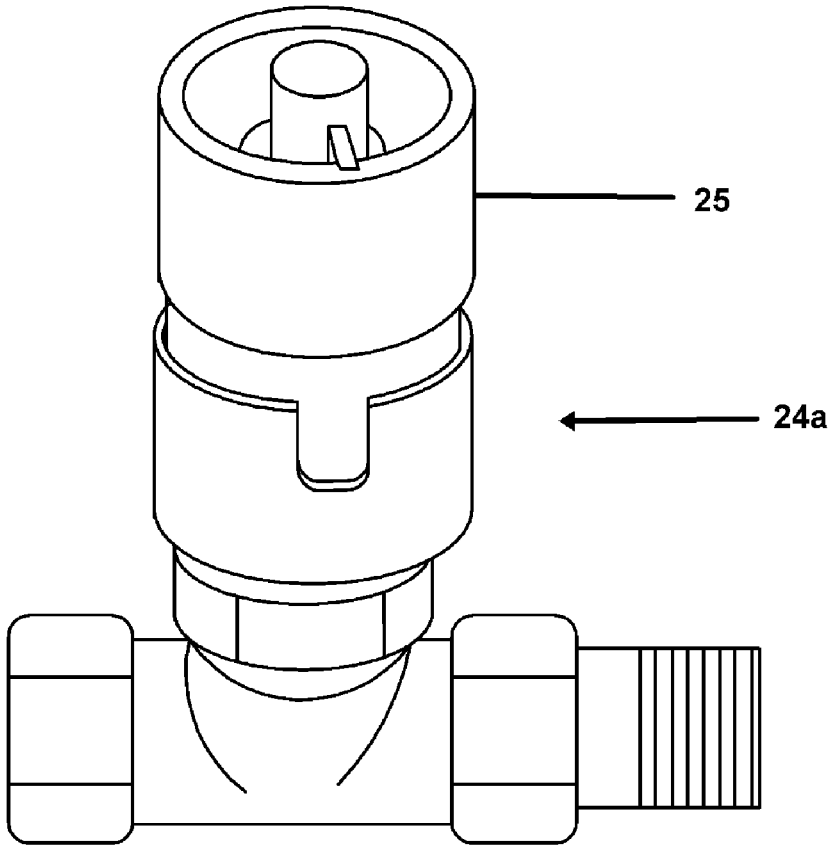
FIG. 6 is an elevation view of a radiator valve used as a mechanical ambient air temperature controlled fluid shutoff valve within an apparatus for maintaining fluid temperature.
Figure 7:
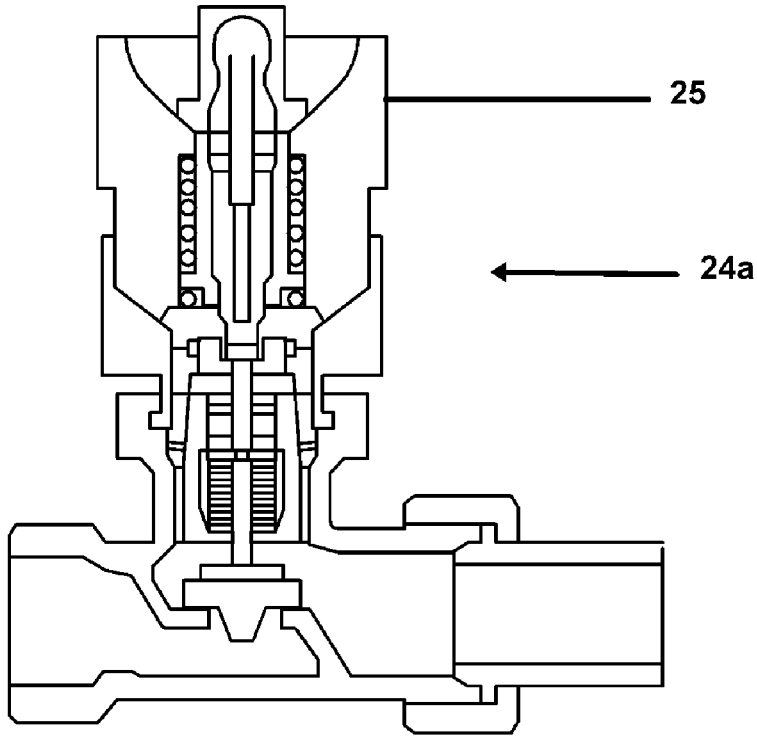
FIG. 7 is a sectional elevation view of the radiator valve of FIG. 6.

The preferred embodiment of an apparatus for maintaining water temperature is illustrated in FIG. 5. It is schematically depicted within FIG. 1. The apparatus for regulating water temperature is comprised of a water inlet 22, a mechanical ambient air temperature controlled water shutoff valve 24, a water check valve 26 and a water outlet 28. The ambient air temperature controlled water shutoff valve 24 is mechanically, rather than electrically, operated. The shutoff valve 24 is a valve which opens upon a falling temperature. The shutoff valve 24 has an air sensor 27 which controls the opening and closing of the valve 24. The valve 24 is connected in series with the water inlet 22. The shutoff valve 24 starts and stops the flow of water based upon the temperature of the water, as communicated to the air sensor. Preferably, the shutoff valve 24 is a valve having a manually adjustable shutoff temperature. This will permit the regulated water temperature to be varied. A manually adjustable temperature setpoint controller 25 is positioned upon the external periphery of the mechanical ambient air temperature controlled water shutoff valve 24, outside of the water jacket. As the water cools, the ambient air 23 surrounding the valve 24 cools. The temperature of the ambient air 23 is detected by an air sensor 27 on the mechanical ambient air temperature controlled water shutoff valve 24. The temperature at which the mechanical ambient air temperature controlled water shutoff valve 24 opens is set by the manually adjustable temperature setpoint controller 25. Common residential and commercial heating radiator valves 24*a*, such as the radiator valve shown in FIG. 6 and FIG. 7, have the features of the mechanical ambient air temperature controlled water shutoff valves described herein. Because the manually adjustable temperature setpoint controller 25 is positioned outside of the water, it allows easy access. The apparatus does not need to be disassembled to change the temperature setpoint of the valve 24.

The water check valve 26 is connected in series with the ambient air temperature controlled water shutoff valve 24. The check valve 26 is aligned for permitting the flow of water in a direction from hot to cold only.

The water outlet 28 is connected in series with the ambient air temperature controlled water shutoff valve 24 and the water check valve 26. The ambient air temperature controlled water shutoff valve 24 and the water check valve 26 are positioned between the water inlet 22 and the water outlet 28. The check valve 26 prevents cold water from mixing with hot water near the water inlet 22, thereby causing a reduction of water temperature within any hot water located within the water inlet 22. The preferred material for the water inlet 22, the body of the water shutoff valve 24 and the water outlet 28 is brass. Preferably, the check valve 26 is constructed from plastic and rubber and is sealed with a rubber o-ring. Such check valves 26 are commonly available in the plumbing industry.

Figure 1:
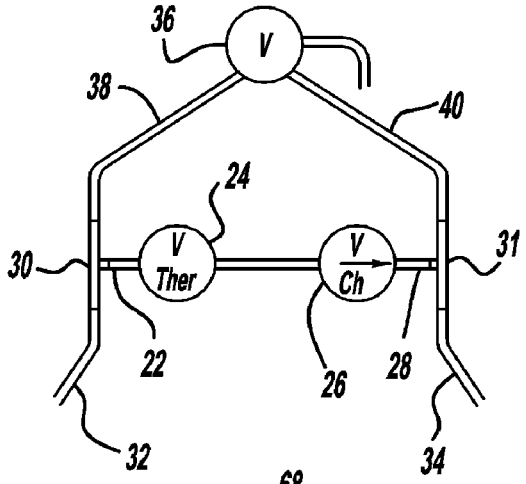
FIG. 1 is a schematic depiction of an apparatus for maintaining fluid temperature connected to a discharge valve to create a temperature controlled faucet.
Figure 2:
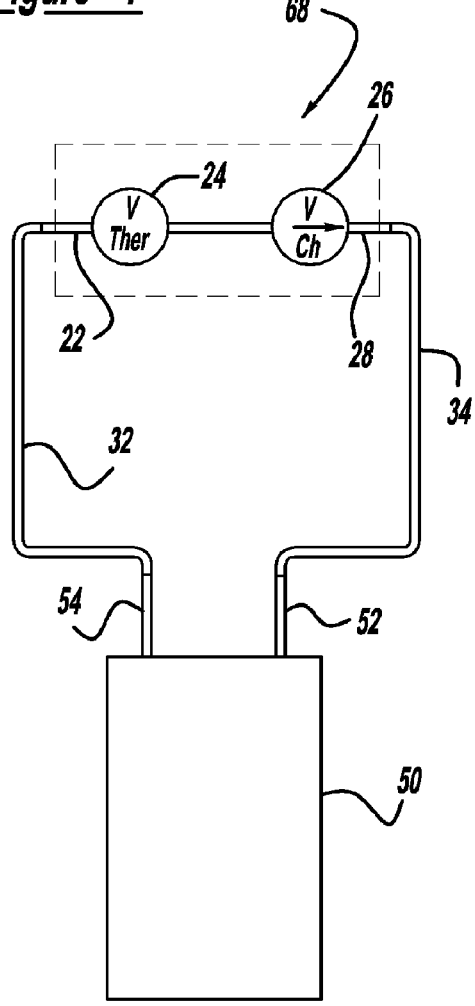
FIG. 2 is a schematic depiction of an apparatus for maintaining fluid temperature, configured as a temperature control assembly, connected to a hot water supply pipe and a cold water supply pipe emanating from a hot water heater to create a temperature controlled hot water supply system.
Figure 3:
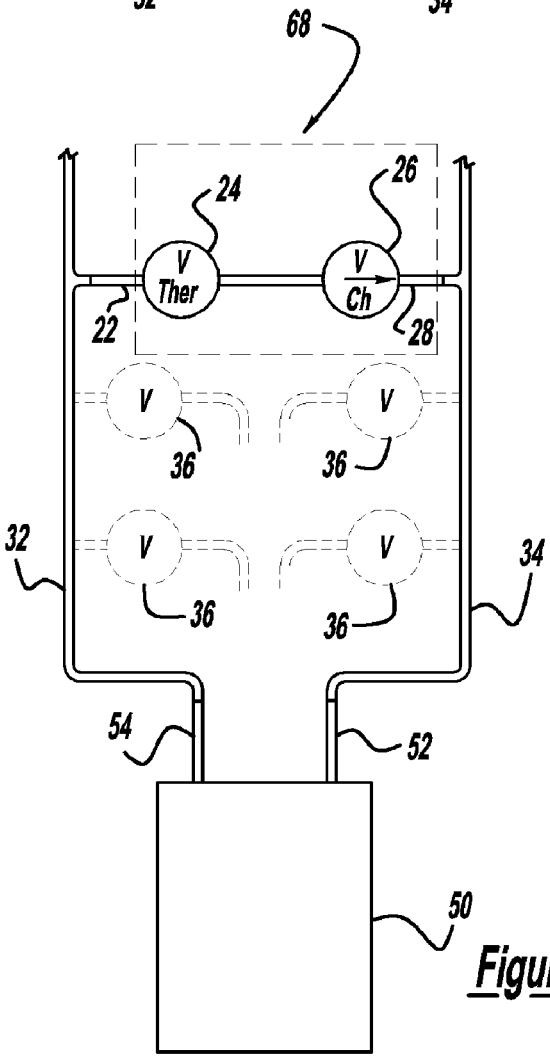
FIG. 3 is a schematic depiction of a temperature controlled hot water supply system created by connecting an apparatus for maintaining water temperature, configured as a temperature control assembly, to the distal end of a hot water supply pipe connected to a water heater and to the distal end of a cold water supply pipe connected to the water heater.
Figure 4:
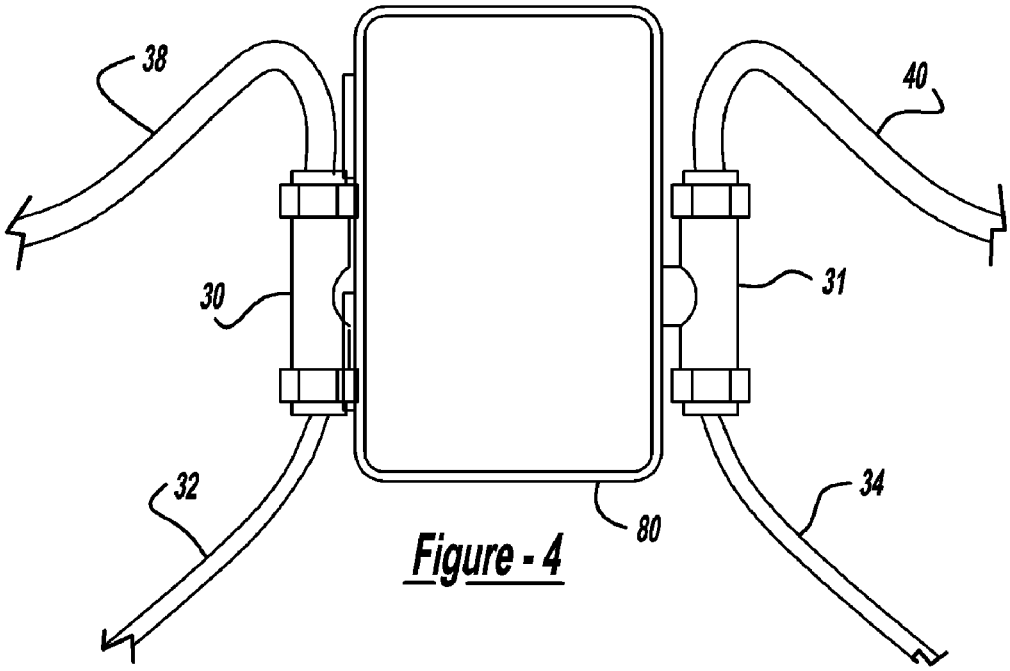
FIG. 4 is a perspective view of an apparatus for maintaining water temperature enclosed within an insulation box with a door, wherein the door is closed.

The apparatus for regulating water temperature may be used to create a temperature controlled hot water supply system, as shown in FIGS. 2 and 3, or a temperature controlled faucet, as shown in FIG. 1. If it is to be used to create a temperature controlled hot water supply system, as shown in FIGS. 2 and 3, the water inlet 22 is shaped and sized to connect the apparatus to a hot water supply pipe 32 and the water outlet 28 is shaped and sized to connect the apparatus to a cold water supply pipe 34. This will allow the inlet 22 of the apparatus to be connected to the hot water side of a water supply system and the outlet 28 of the apparatus to be connected to the cold water side of a water supply system. If the apparatus is to be used to create a temperature controlled faucet, as shown in FIG. 1, a first tee 30 having three branches is connected at its second branch to the water inlet 22. The first branch of the first tee 30 is sized and shaped to connect to the hot water inlet 38 of a faucet 36 having a hot water inlet 38 and a cold water inlet 40. The third branch of the first tee 30 is sized and shaped to connect to a hot water supply pipe 32. This permits connecting the apparatus to the hot water side of a water supply system. Additionally, if the apparatus is to be used to create a temperature controlled faucet, a second tee 31 having three branches is connected at its second branch to the water outlet 28 of the apparatus. The first branch of the second tee 31 is sized and shaped to connect to the cold water inlet 40 of the faucet 36 having a hot water inlet 38 and a cold water inlet 40. The third branch of the second tee 31 is sized and shaped to connect to a cold water supply pipe 34. This permits connecting the apparatus to the cold water side of a water supply system. The temperature of the water at the junction of the three branches of the first tee 30 is controlled and maintained when a hot water supply pipe 32 is connected to the third branch of the first tee 30, a cold water supply pipe 34 is connected to the third branch of the second tee 31, the first branch of the first tee 30 is connected to the hot water inlet 38 of the faucet 36 and the first branch of the second tee 31 is connected to the cold water inlet 40 of the faucet 36. Preferably, the tees 30, 31 are constructed from brass and attached to the apparatus water inlet 22 and the apparatus water outlet 28 by threaded connections. For optimal performance the ambient air temperature controlled water shutoff valve 24 is surrounded by an insulation box 80 having a door. The insulation box 80 isolates the ambient air temperature controlled water shutoff valve 24 from outside ambient air and reduces the temperature response time of the ambient air temperature controlled water shutoff valve 24, as previously described.

To create a temperature controlled faucet, the version of the apparatus for maintaining water temperature having a first tee 30 connected to the water inlet 22 of the apparatus and a second tee 31 connected to the water outlet 28 of the apparatus, as described above, is connected to a faucet 36 having a hot water inlet 38 and a cold water inlet 40, as shown in FIG. 1. The first branch of the first tee 30 is connected to the hot water inlet 38 of the faucet 36. The first branch of the second tee 31 is connected to the cold water inlet 40 of the faucet 36. When a hot water supply pipe 32 is connected to the third branch of the first tee 30 and a cold water supply pipe 34 is connected to the third branch of the second tee 31, the temperature of water at the junction of the three branches of the first tee 30 is controlled and maintained. Optimum performance is obtained by enclosing the apparatus for regulating water temperature within an insulation box 80.

To create a temperature controlled hot water supply system, the version of the apparatus for maintaining water temperature without the tees 30, 31, as described above, is used. The temperature controlled hot water supply system is comprised of a hot water heater 50, a hot water supply pipe 32, a cold water supply pipe 34 and the apparatus for regulating water temperature, as shown in FIGS. 2 and 3. The apparatus for regulating water temperature without the tees 30, 31 is configured as and functions as a temperature control assembly 68. The hot water heater 50 has a cold water inlet 52 and a hot water outlet 54. The hot water supply pipe 32 has two terminations. One termination is connected to the hot water outlet 54 of the hot water heater 50. The cold water supply pipe 34 also has two terminations. One termination is connected to the cold water inlet 52 of the hot water heater 50. The temperature control assembly 80 is comprised of a water inlet 22, a water outlet 28, a mechanical ambient air temperature controlled water shutoff valve 24 and a water check valve 26. The ambient air temperature controlled shutoff valve 24 opens upon a falling temperature. The valve 24 has an air sensor 27. Preferably, the valve is a radiator valve 24*a*. It is connected in series with the water inlet 22 of the temperature control assembly. The ambient air temperature controlled shutoff valve 24 starts and stops the flow of water based upon the temperature of the water, as communicated to the air sensor 27. The water check valve 26 is connected in series with the ambient air temperature controlled water shutoff valve 24 and the water outlet 28 of the temperature control assembly. The check valve 26 is aligned for permitting the flow of water in a direction from hot to cold only. The temperature control assembly water inlet 22 is connected to the other termination of the hot water supply pipe 32. The temperature control assembly 68 water outlet 28 is connected to the other termination of the cold water supply pipe 34. This causes the flow of the water between said other termination of the hot water supply pipe 32 and said other termination of the cold water supply pipe 34 to be regulated based upon the water temperature. It further causes the temperature of the water within the hot water supply pipe 32 to be controlled and maintained. For optimal performance an insulation box 80 surrounds the ambient air temperature controlled shutoff valve 24. This isolates the ambient air temperature controlled water shutoff valve 24 from outside ambient air and reduces the temperature response time of the ambient air temperature controlled water shutoff valve 24.

What is claimed is:

1. An apparatus for maintaining fluid temperature comprising:

a fluid inlet;

a mechanical ambient air temperature controlled fluid shutoff valve which opens upon a falling temperature communicated to an air sensor on the valve, connected in series with the fluid inlet, for starting and stopping the flow of fluid based upon the temperature of the fluid as communicated to the air sensor, said mechanical temperature controlled fluid shutoff valve having a manually adjustable temperature setpoint controller positioned upon its external periphery outside of the fluid;

a fluid check valve connected in series with the temperature controlled fluid shutoff valve aligned for permitting the flow of fluid in a direction from hot to cold only; and a fluid outlet connected in series with the temperature controlled fluid shutoff valve and the check valve, the temperature controlled fluid shutoff valve and the check valve being positioned between the fluid inlet and the fluid outlet.

2. The apparatus for maintaining fluid temperature of claim 1, wherein:

the fluid inlet is shaped and sized to connect the apparatus to a hot fluid supply pipe, for connecting the apparatus to the hot fluid side of a fluid supply system having a hot fluid side and a cold fluid side; and the fluid outlet is shaped and sized to connect the apparatus to a cold fluid supply pipe, for connecting the apparatus to the cold fluid side of a fluid supply system having a hot fluid side and a cold fluid side.

3. The apparatus for maintaining fluid temperature of claim 1 further comprising:

a first tee having three branches, one of which is sized and shaped to connect to the hot fluid inlet of a discharge valve having a hot fluid inlet and a cold fluid inlet, the second of which is connected to the fluid inlet of the apparatus, and the third of which is sized and shaped to connect to a hot fluid supply pipe for connecting the apparatus to the hot fluid side of a fluid supply system having a hot fluid side and a cold fluid side; and a second tee having three branches, one of which is sized and shaped to connect to the cold fluid inlet of the discharge valve having a hot fluid inlet and a cold fluid inlet, the second of which is connected to the fluid outlet of the apparatus, and the third of which is sized and shaped to connect to a cold fluid supply pipe for connecting the apparatus to the cold fluid side of a fluid supply system having a hot fluid side and a cold fluid side, whereby the temperature of fluid at the junction of the three branches of the first tee is controlled and maintained when a hot fluid supply pipe is connected to the third branch of the first tee, a cold fluid supply pipe is connected to the third branch of the second tee, the first branch of the first tee is connected to the hot fluid inlet of the discharge valve and the first branch of the second tee is connected to the cold fluid inlet of the discharge valve.

4. The apparatus for maintaining fluid temperature of claim 1, further comprising insulation surrounding the temperature controlled fluid shutoff valve, for isolating the temperature controlled fluid shutoff valve from outside ambient air and reducing the temperature response time of the temperature controlled fluid shutoff valve.

5. The apparatus for maintaining fluid temperature of claim 2, further comprising insulation surrounding the temperature controlled fluid shutoff valve, for isolating the temperature controlled fluid shutoff valve from outside ambient air and reducing the temperature response time of the temperature controlled fluid shutoff valve.

6. The apparatus for maintaining fluid temperature of claim 3, further comprising insulation surrounding the temperature controlled fluid shutoff valve, for isolating the temperature controlled fluid shutoff valve from outside ambient air and reducing the temperature response time of the temperature controlled fluid shutoff valve.

7. The apparatus for maintaining fluid temperature of claim 1, wherein the temperature controlled shutoff valve is a radiator valve.

8. An apparatus for maintaining water temperature comprising:

a water inlet;

a mechanical ambient air temperature controlled water shutoff valve which opens upon a falling temperature communicated to an air sensor on the valve, connected in series with the water inlet, for starting and stopping the flow of water based upon the temperature of the water as communicated to the air sensor, said mechanical temperature controlled fluid shutoff valve having a manually adjustable temperature setpoint controller positioned upon its external periphery outside of the water;

a water check valve connected in series with the temperature controlled water shutoff valve aligned for permitting the flow of water in a direction from hot to cold only; and a water outlet connected in series with the temperature controlled water shutoff valve and the check valve, the temperature controlled water shutoff valve and the check valve being positioned between the water inlet and the water outlet.

9. The apparatus for maintaining water temperature of claim 8, wherein:

the water inlet is shaped and sized to connect the apparatus to a hot water supply pipe, for connecting the apparatus to the hot water side of a water supply system having a hot water side and a cold water side; and the water outlet is shaped and sized to connect the apparatus to a cold water supply pipe, for connecting the apparatus to the cold water side of a water supply system having a hot water side and a cold water side.

10. The apparatus for maintaining water temperature of claim 8, further comprising:

a first tee having three branches, one of which is sized and shaped to connect to the hot water inlet of a faucet having a hot water inlet and a cold water inlet, the second of which is connected to the water inlet of the apparatus, and the third of which is sized and shaped to connect to a hot water supply pipe for connecting the apparatus to the hot water side of a water supply system having a hot water side and a cold water side; and a second tee having three branches, one of which is sized and shaped to connect to the cold water inlet of the faucet having a hot water inlet and a cold water inlet, the second of which is connected to the water outlet of the apparatus, and the third of which is sized and shaped to connect to a cold water supply pipe for connecting the apparatus to the cold water side of a water supply system having a hot water side and a cold water side, whereby the temperature of water at the junction of the three branches of the first tee is controlled and maintained when a hot water supply pipe is connected to the third branch of the first tee, a cold water supply pipe is connected to the third branch of the second tee, the first branch of the first tee is connected to the hot water inlet of the faucet and the first branch of the second tee is connected to the cold water inlet of the faucet.

11. The apparatus for maintaining water temperature of claim 8, further comprising insulation surrounding the temperature controlled water shutoff valve, for isolating the temperature controlled water shutoff valve from outside ambient air and reducing the temperature response time of the temperature controlled water shutoff valve.

12. The apparatus for maintaining water temperature of claim 9, further comprising insulation surrounding the temperature controlled water shutoff valve, for isolating the temperature controlled water shutoff valve from outside ambient air and reducing the temperature response time of the temperature controlled water shutoff valve.

13. The apparatus for maintaining water temperature of claim 10, further comprising insulation surrounding the temperature controlled water shutoff valve, for isolating the temperature controlled water shutoff valve from outside ambient air and reducing the temperature response time of the temperature controlled water shutoff valve.

14. The apparatus for maintaining water temperature of claim 8, wherein the temperature controlled shutoff valve is a radiator valve.

15. A temperature controlled faucet comprising:

a faucet having a hot water inlet and a cold water inlet; and a temperature control assembly comprising:

a water inlet;

a mechanical ambient air temperature controlled water shutoff valve which opens upon a falling temperature communicated to an air sensor on the valve, connected in series with the water inlet, for starting and stopping the flow of water based upon the temperature of the water as communicated to the air sensor, said mechanical temperature controlled fluid shutoff valve having a manually adjustable temperature setpoint controller positioned upon its external periphery outside of the water;

a water check valve connected in series with the temperature controlled water shutoff valve aligned for permitting the flow of water in a direction from hot to cold only;

a water outlet connected in series with the temperature controlled water shutoff valve and the check valve, the temperature controlled water shutoff valve and the check valve being positioned between the water inlet and the water outlet;

a first tee having three branches, one of which is connected to the hot water inlet of the faucet, the second of which is connected to the inlet of the temperature control assembly, and the third of which is sized and shaped to connect to a hot water supply pipe for connecting the temperature control assembly to the hot water side of a water supply system having a hot water side and a cold water side; and a second tee having three branches, one of which is connected to the cold water inlet of the faucet, the second of which is connected to the outlet of the temperature control assembly, and the third of which is sized and shaped to connect to a cold water supply pipe for connecting the temperature control assembly to the cold water side of a water supply system having a hot water side and a cold water side, whereby the temperature of water at the junction of the three branches of the first tee is controlled and maintained when a hot water supply pipe is connected to the third branch of the first tee and a cold water supply pipe is connected to the third branch of the second tee.

16. The temperature controlled faucet of claim 15, further comprising insulation surrounding the temperature controlled water shutoff valve, for isolating the temperature controlled water shutoff valve from outside ambient air and reducing the temperature response time of the temperature controlled water shutoff valve.

17. The temperature control the faucet of claim 15, wherein the temperature controlled shutoff valve is a radiator valve.

18. A temperature controlled hot water supply system comprising:

a hot water heater having a cold water inlet and a hot water outlet;

a hot water supply pipe having two terminations, one of which is connected to the hot water outlet of the water heater;

a cold water supply pipe having two terminations, one of which is connected to the cold water inlet of the water heater; and a temperature control assembly comprising:

a water inlet;

a water outlet;

a mechanical ambient air temperature controlled water shutoff valve which opens upon a falling temperature communicated to an air sensor on the valve, connected in series with the water inlet of the temperature control assembly, and positioned to lie between the water inlet of the temperature control assembly and the water outlet of the temperature control assembly, for starting and stopping the flow of water based upon the temperature of the water as communicated to the air sensor, said mechanical temperature controlled fluid shutoff valve having a manually adjustable temperature setpoint controller positioned upon its external periphery outside of the water; and a water check valve connected in series with the temperature controlled water shutoff valve and the water outlet of the temperature control assembly, aligned for permitting the flow of water in a direction from hot to cold only, wherein the temperature control assembly water inlet is connected to the other hot water supply pipe termination and the temperature control assembly water outlet is connected to the other cold water supply termination, whereby the flow of water between said other termination of the hot water supply pipe and said other termination of the cold water supply pipe is regulated based upon water temperature and the temperature of water within the hot water supply pipe is controlled and maintained.

19. The temperature controlled hot water supply system of claim 18, further comprising insulation surrounding the temperature controlled water shutoff valve, for isolating the temperature controlled water shutoff valve from outside ambient air and reducing the temperature response time of the temperature controlled water shutoff valve.

20. The hot water supply system of claim 18, wherein the temperature controlled shutoff valve is a radiator valve.

* * * * *